US006786493B2

(12) United States Patent
Hong

(10) Patent No.: US 6,786,493 B2
(45) Date of Patent: Sep. 7, 2004

(54) EASILY ADJUSTED SKATE

(76) Inventor: Shi-Chao Hong, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/059,973

(22) Filed: Jan. 30, 2002

(65) Prior Publication Data

US 2003/0141679 A1 Jul. 31, 2003

(51) Int. Cl.[7] ..... B62M 7/14
(52) U.S. Cl. ..... 280/11.26
(58) Field of Search ..... 280/11.26, 11.16, 280/11.19, 11.231, 11.221, 11.27

(56) References Cited

U.S. PATENT DOCUMENTS

| | | | | | |
|---|---|---|---|---|---|
| 10,664 | A | * | 11/1885 | Hall | 280/11.19 |
| 2,051,414 | A | * | 8/1936 | Pardon et al. | 280/11.26 |
| 3,202,434 | A | * | 8/1965 | Goodman | 280/11.26 |
| 4,767,127 | A | * | 8/1988 | Olivieri | |
| 5,931,478 | A | * | 8/1999 | Chang | 280/11.231 |
| 6,497,421 | B1 | * | 12/2002 | Edgerley et al. | 280/11.19 |
| 6,517,091 | B1 | * | 2/2003 | Fisher et al. | 280/11.26 |
| 6,547,261 | B2 | | 4/2003 | Gorza | |
| 2004/0046339 | A1 | * | 3/2004 | Chen | 280/11.26 |

FOREIGN PATENT DOCUMENTS

FR 2672812 * 8/1992

OTHER PUBLICATIONS

US patent application Publication 2001/0006281—dated Jul. 2001.*
US patent Office Publication 2002/0171210—dated Nov. 2002.*

* cited by examiner

*Primary Examiner*—Bryan Fischmann

(57) ABSTRACT

An easily adjusted skate includes a front seat, a rear seat and a buckle structure for connecting the front seat and the rear seat. The buckle structure is formed by a round lower cover, a buckle, and a tooth bank. An upper side of the lower cover has a confining seat and the confining seat has guide grooves at two sides thereof. Thereby, the buckle slides along the linear guide grooves of the lower cover. One inner end of the buckle has engaging teeth which protrude downward and extend inward so that the engaging teeth are exactly engaged to the tooth bank at a lower end of the front seat. The user can press the buckle from a lateral side of the skate so that the engaging teeth of the buckle separates from the tooth bank; and thus the size of the skate is adjusted.

3 Claims, 6 Drawing Sheets

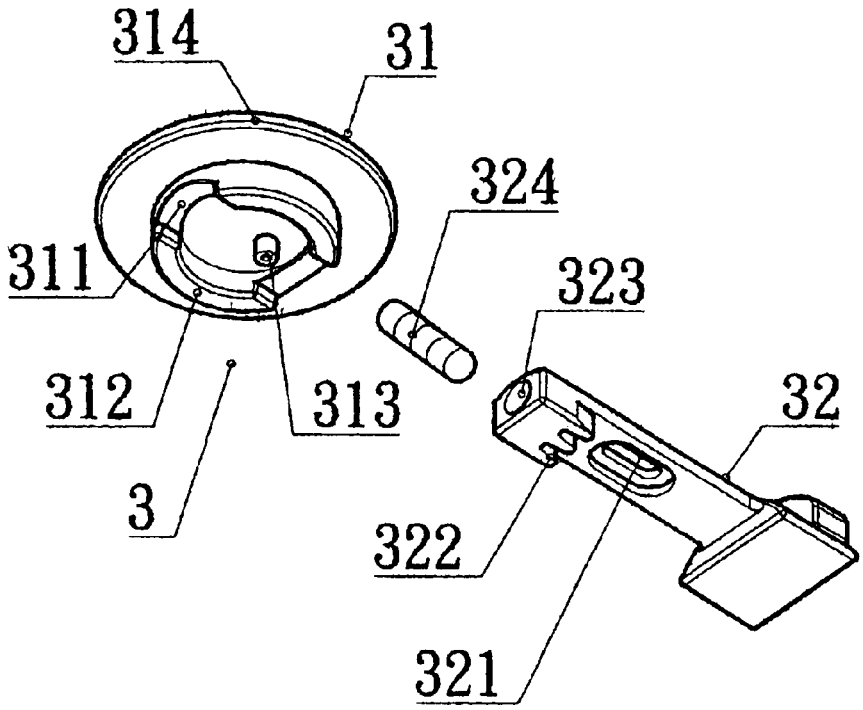
Fig. 1-A

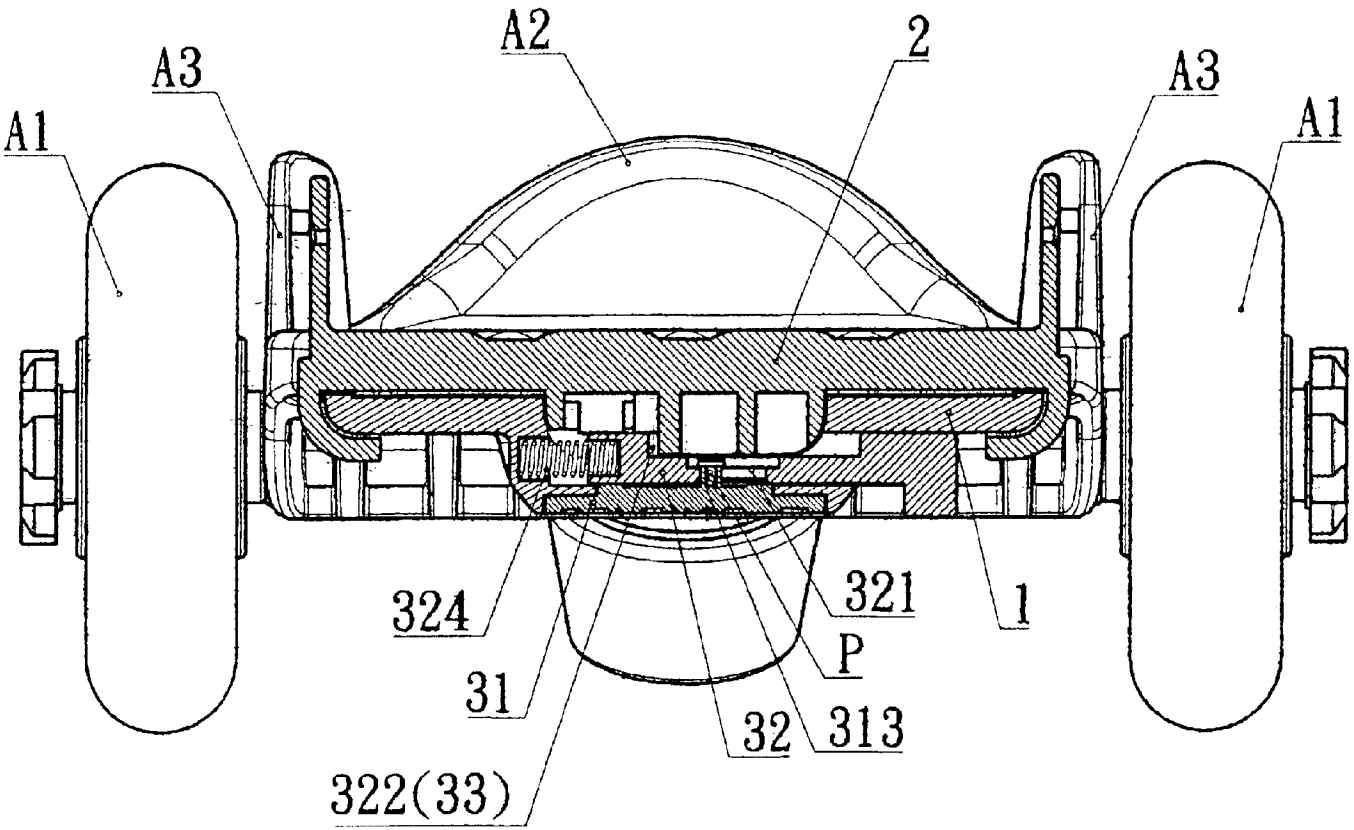
FIG. 3-A

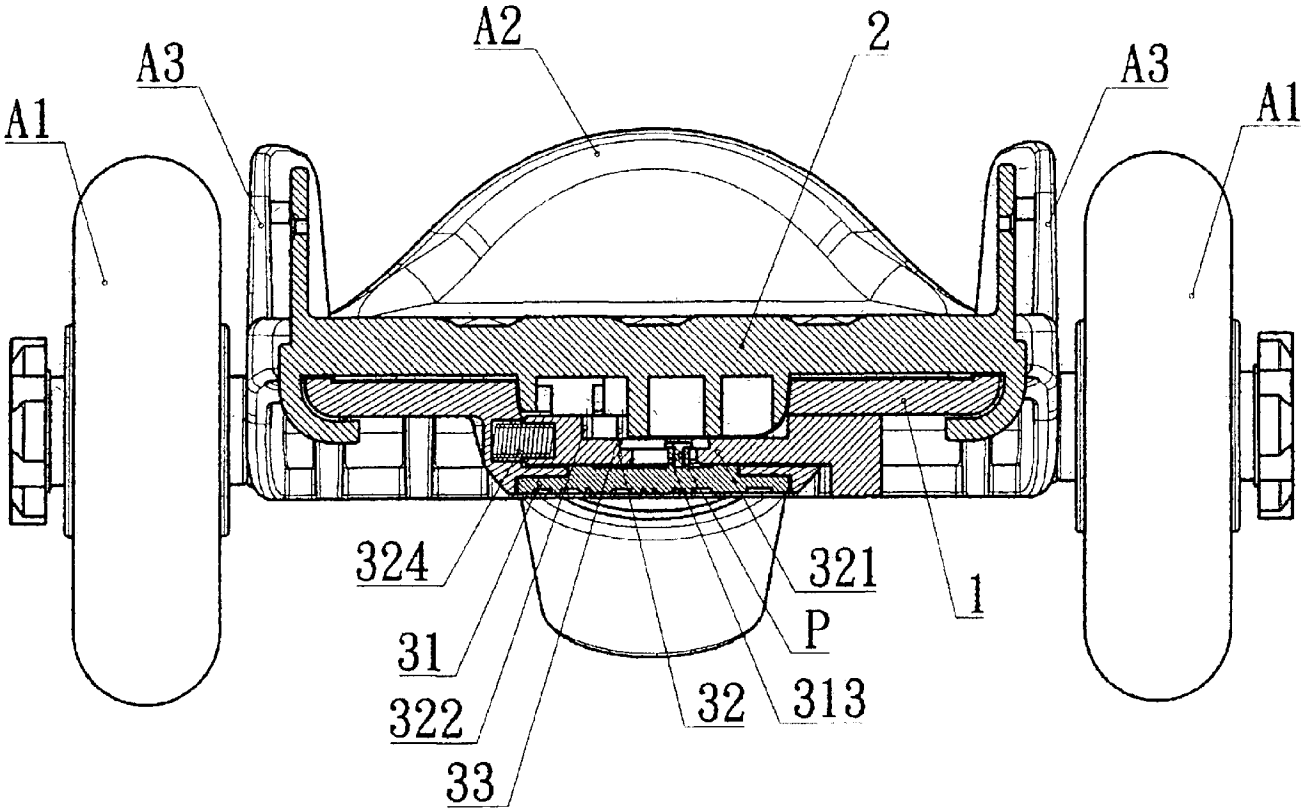
FIG. 3-B

FIG. 4-A

EASILY ADJUSTED SKATE

BACKGROUND OF THE INVENTION

1. Field of the Invention

The present invention relates to skates, and particularly to an easily adjusted skate, wherein user can press a buckle from a lateral side of the skate so that engaging teeth of the buckle is released; and thus the size of the skate is adjusted.

2. Description of Related Art

Skating is an activity requiring a large output of energy. A known prior art skate has a front seat with a elleptical receiving hole and a rear seat which is tightly locked to a rear end of the front seat. When it is desired to adjust the size of the skate to match the size of the feet of the user, a stud may move in the receiving groove to a desired length. However, this kind of skate has some shortcomings which are necessary to be improved upon.

SUMMARY OF THE INVENTION

Accordingly, the primary object of the present invention is to provide an easily adjusted skate comprising a front seat, a rear seat and a buckle structure for connecting the front seat and the rear seat. The buckle structure is formed a round lower cover, a buckle, and a tooth bank. An upper side of the lower cover has a confining seat and the confining seat has guide grooves at two sides thereof. Thereby, the buckle moves straightly along the guide grooves of the lower cover. One inner end of the buckle has engaging teeth which protrude downward and extend inward so that the engaging teeth is exactly engaged to the tooth bank at a lower end of the front seat. The user can press the buckle from a lateral side of the skate so that the engaging teeth of the buckle separates from the tooth bank; and thus the size of the skate is adjusted.

The various objects and advantages of the present invention will be more readily understood from the following detailed description when read in conjunction with the appended drawing.

BRIEF DESCRIPTION OF THE DRAWINGS

FIG. 1A shows the details of the buckle structure illustrated in FIG. 1.

FIG. 3A is a front view showing the engagement state of the present invention.

FIG. 3B is a front view showing the disengagement state of the present invention.

FIG. 4A shows the details of the front seat illustrated in FIG. 4.

DETAILED DESCRIPTION OF THE PREFERRED EMBODIMENTS

Figure 1:
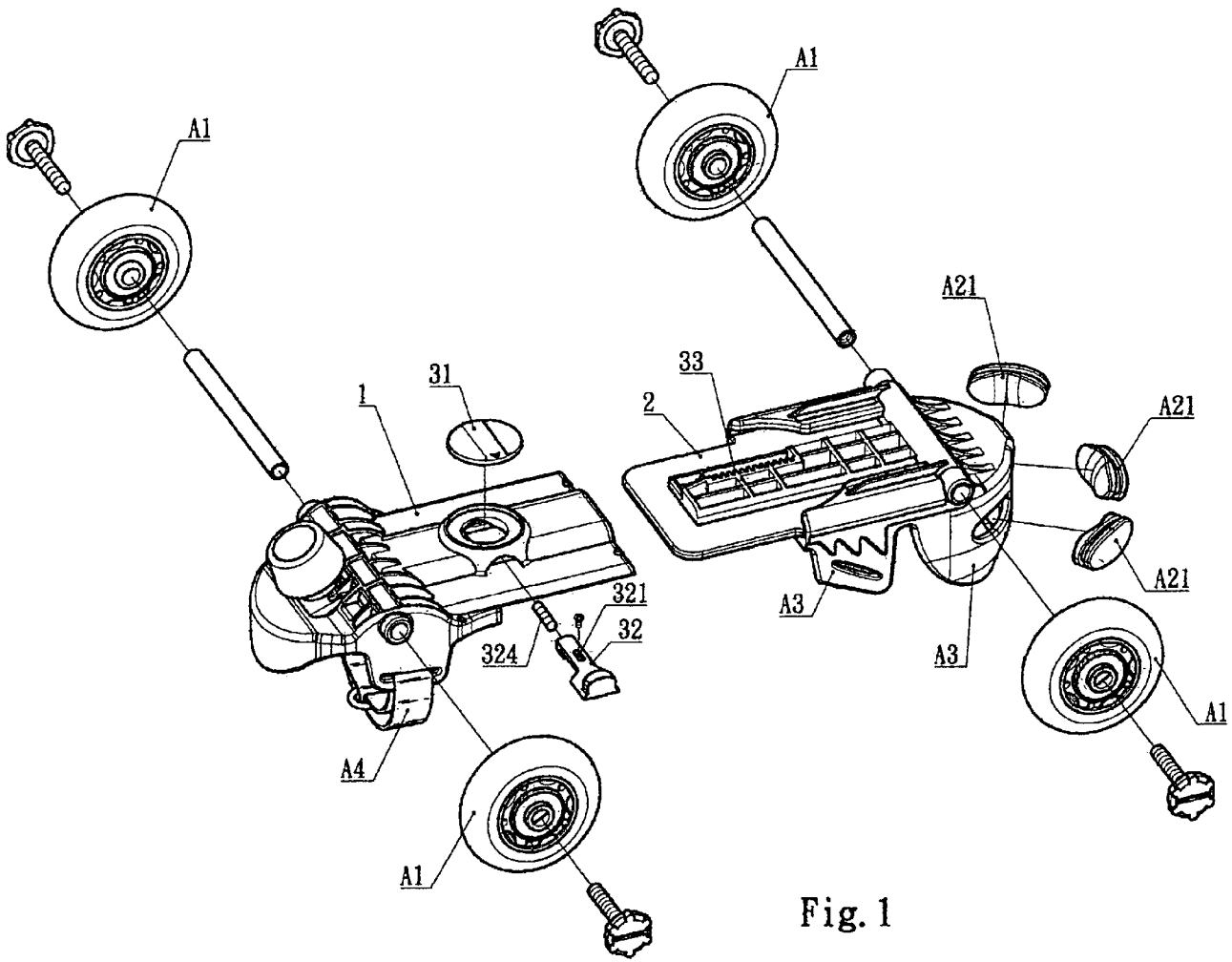
FIG. 1 is an exploded perspective view of the present invention.
Figure 2:
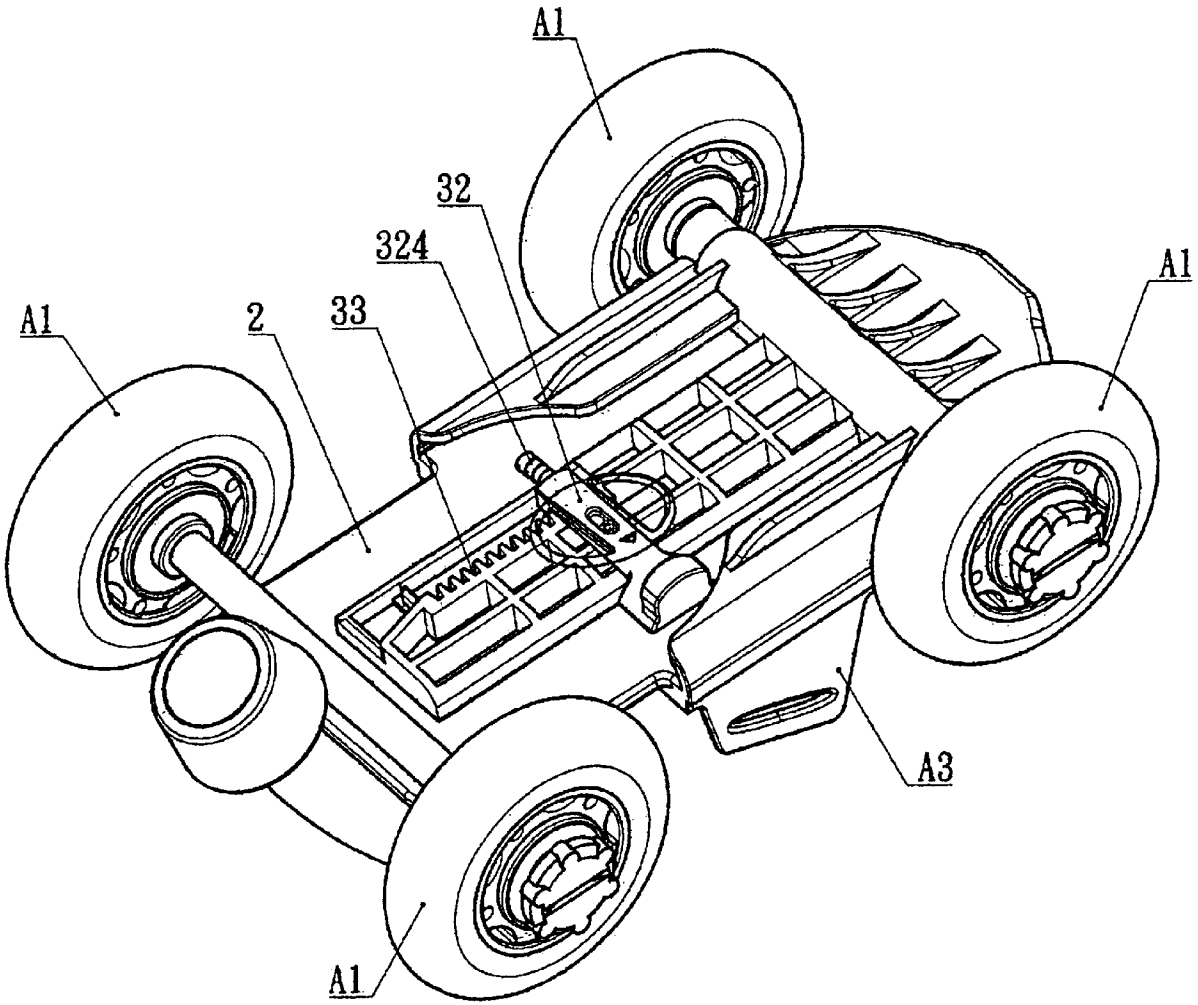
FIG. 2 is an assembled perspective view of the present invention.

With reference to FIGS. 1 and 2, the structure of the present invention is illustrated. The skateboard shoe A is formed by a front seat 1, a rear seat 2 and a buckle structure 3 for connecting the front seat 1 and the rear seat 2. Both the front seat 1 and the rear seat 2 are formed with shoe surfaces A2. Two lateral wings A3 and buckling surface A4 are extended from the lateral sides of the seat so that the user may wear shoes which are then buckled to the skate A. The features of the present invention will be described hereinafter.

The buckle structure 3 is formed by a round lower cover 31 fastened to the lower center of the front seat 1, a buckle 32 locked to an upper side of the lower cover 31 by a stud P, a tooth bank 33 integrally formed to a bottom of the rear seat 2 and exactly coupled to the lateral side of the buckle 32.

An upper side of the lower cover 31 has a confining seat 312 having guide grooves 311 at two sides thereof. A locking shaft seat 313 is formed between the two guide grooves 311 for locking the buckle 32 so that the buckle 32 is confined to only slide along the linear guide grooves 311. A periphery of the lower cover 31 is installed with a buckling disk 314. Thereby, the lower cover 31 may be tightly coupled to a lower end of the front seat 1 by buckling.

The buckle 32 resembles a long plate. The plate body has a stepped elliptical hole 321. The elliptical hole 321 is exactly matched to an upper side of the locking shaft seat 313 of the lower cover. The stud P loosely inserts into the locking shaft seat 313 from the elliptical hole 321 so as to firmly secure the buckle 32 with the lower cover 31. Thereby, the buckle 32 may be arranged to a bottom of the skate A. One end of the buckle 32 slightly protrudes from an outer side of the skate A. Thereby, a user can press the buckle 32 inwards so that the buckle separates from the tooth bank 33. The inner end of the buckle 32 has an engaging teeth 322 which protrude downward and extend inward, so that the engaging teeth 322 is exactly engaged to the tooth bank 33 at a lower end of the front seat 1. One end of the buckle 32 passing through the lower cover 31 has a receiving hole 323. A spring 324 is positioned in the receiving hole 323. An outer end of the spring 324 resists against another side of the front seat 1.

With reference to FIG. 5, the inner side of the shoe surface A2 of the skate A is distributed with a plurality of elastic pads A21 so that the user's rear heel can adhere to the pads comfortably. Moreover, it provides an adjusting size for matching the size of the user's heel.

Figure 4:
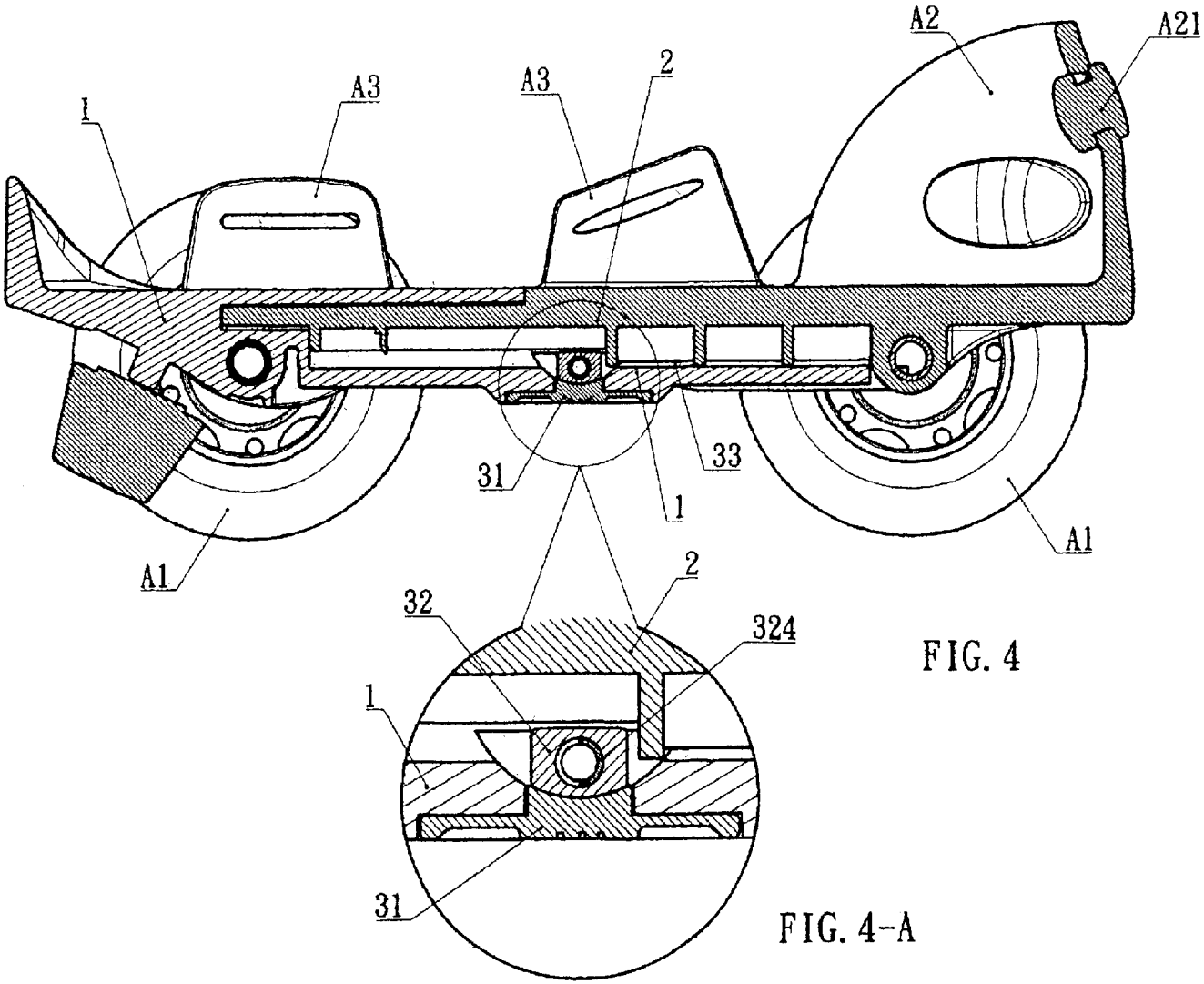
FIG. 4 is a cross sectional view of the present invention.

The assembly way of the present invention will be illustrated in FIGS. 3 and 4.

The buckle 32 is locked to an upper end of the lower cover 31 by the stud P. Then the lower cover is tightly fixed to a lower end of the front seat 1 so that the buckle 32 is engaged to the engaging teeth 322 so that the front seat 1 and the rear seat 2 are engaged (referring to FIG. 3).

When it is desired to adjust the size of the skate A to match the size of the user, the user can press the buckle 32 from a lateral side of the skate A. Then, the buckle 32 will compress the spring 324 so that the engaging teeth 322 of the buckle 32 separate from the tooth bank 33. Then the front seat 1 is disengaged from the rear seat 2. Then, the whole rear seat 2 moves backwards or forwards for properly adjusting the size of the skate A. Then the buckle 32 is released. By the resilient force of the spring 324, the buckle 32 is pushed to be engaged with the tooth bank 33, thereby, being positioned properly (referring to FIG. 4).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A skate comprising a front seat, a rear seat and a buckle and a lower cover for connecting the front seat and the rear seat; wherein the buckle is installed in the lower cover and tightly fixed to a predetermined position of the front seat, the buckle is fixed to an upper side of the lower cover by a stud, a tooth bank is integrally formed to a bottom of the rear seat and engaged to a lateral side of the buckle;

an upper side of the lower cover has a confining seat; the confining seat has guide grooves at two sides thereof; a locking shaft seat is formed between the two guide grooves; and the buckle has a stepped elliptical hole at a predetermined position thereof; the elliptical hole is aligned with the locking shaft seat of the lower cover so that the locking shaft seat is within the elliptical hole; thereby, the buckle slides along the linear guide grooves of the lower cover; one lateral side of the buckle has engaging teeth which protrude downward and extend inward so that the engaging teeth are engaged with the tooth bank at a lower end of the front seat; one end of the buckle which passes through the lower cover has a receiving hole; a spring is positioned in the receiving hole; an outer end of the spring is in contact with the front seat;

wherein the buckle is capable of being pressed by a user from a lateral side; the buckle will compress the spring so that the engaging teeth of the buckle separates from the tooth bank; and thus the size of the skate is capable of being adjusted.

2. The skate as claimed in claim 1, wherein lateral wings of the rear seat have elastic pads installed in holes in the lateral wings.

3. The skate as claimed in claim 1, wherein a distal end of the buckle is formed with a receiving hole for receiving the spring.

* * * * *